United States Patent [19]

Naganuma et al.

[11] Patent Number: 4,993,829

[45] Date of Patent: Feb. 19, 1991

[54] DEVELOPING APPARATUS FOR AN IMAGE FORMING APPARATUS

[75] Inventors: Seiko Naganuma; Satoshi Haneda, both of Hachioji, Japan

[73] Assignee: Konica Corporation, Tokyo, Japan

[21] Appl. No.: 425,751

[22] Filed: Oct. 23, 1989

[30] Foreign Application Priority Data

Oct. 24, 1988 [JP] Japan ..... 63-269089
Oct. 24, 1988 [JP] Japan ..... 63-269090
Oct. 26, 1988 [JP] Japan ..... 63-271659

[51] Int. Cl.[5] ..... G03G 15/09

[52] U.S. Cl. ..... 355/251; 222/DIG. 1; 355/245; 355/259

[58] Field of Search ..... 355/245, 251, 253, 259; 222/DIG. 1; 118/657

[56] References Cited

U.S. PATENT DOCUMENTS 3,981,272 9/1976 Smith et al. ..... 355/251
4,601,259 7/1986 Yamashita ..... 355/253
4,705,394 11/1987 Watanabe ..... 355/245
4,721,982 1/1988 Ueda ..... 355/253

FOREIGN PATENT DOCUMENTS 0101640 2/1984 European Pat. Off. ..... 355/251
0153990 7/1981 Japan ..... 355/251
0164064 7/1981 Japan ..... 355/253
0262074 11/1987 Japan ..... 355/253

*Primary Examiner*—Arthur T. Grimley
*Assistant Examiner*—Thu Anh Dang
*Attorney, Agent, or Firm*—Jordan B. Bierman

[57] ABSTRACT

A developing apparatus including a developer housing for holding a two-component type developer including toner and a carrier, and a toner housing holding toner to be used to replenish the developer. The developer housing and toner housing are interconnected by a passageway shaped so that toner supplied to the developing housing and the developer contained therein form an interface adjacent to the passageway, in the developer housing. By so shaping the passageway, the amount of toner added to the developer can be adequately controlled, without the use of regulating devices.

11 Claims, 9 Drawing Sheets

DEVELOPING APPARATUS FOR AN IMAGE FORMING APPARATUS

BACKGROUND OF THE INVENTION

The present invention relates to a developing apparatus for an image forming apparatus, and especially to a developing apparatus which conducts development with a two-component developer, consisting of a magnetic carrier and a toner, and supplies as much toner as is consumed for development.

A developing apparatus in which a two-component developer is used for development, is generally composed of a developing sleeve, a stirring unit, and a toner container. The developer stirred in the stirring unit adheres to the circumferential surface of the developing sleeve and is conveyed to the developing region which faces a photoreceptor, in order to develop electrostatic latent images on the photoreceptor. After an amount of toner is consumed by the development, the developer adheres to the circumferential surface of the developing sleeve and is conveyed back to the stirring unit to circulate with the developer.

In order to realize good development when using a two-component developer, the toner content ratio in the developer (toner concentration) must be kept in a prescribed range. In order to detect the toner concentration, either magnetic detection of the developer in the stirring unit is conducted, or the standard latent image formed on the photoreceptor is developed and its reflection is measured to indirectly assess the toner concentration.

The method to detect the toner concentration by measuring the density of the developed standard latent image is indirect and does not necessarily indicate the exact toner concentration in the developer. The toner density measuring method by magnetic detection of the toner is problematic in that the results of the detection are not stable.

Even if as much toner is supplied to the developing unit as was consumed during development according to the measurement results, the toner supplying mechanism and its control system need to be complicated.

Developing methods in which two-component developer is used, are approximately classified into the following three methods.

(a) Two component developer magnetic brush developing method.

This is a conventional method. Brushlike bristles of developer are formed on a portion of the circumferential surface of the developing sleeve, facing the photoreceptor. The developer bristles come into contact with the photoreceptor on which a latent image has been formed.

(b) Two component developer non-contact developing method.

This developing method is disclosed in Japanese Patent Publication Open to Public Inspection No. 181362/1984 and No. 176069/1985. According to this developing method, a thin layer of developer is formed on the circumferential surface of the developing sleeve and development is conducted under the condition that there is a space between the toner on the sleeve and the photoreceptor.

(c) One component developer non-contact developing method in which two component developer is used.

For example, according to Japanese Patent Publication Open to Public Inspection No. 42768/1985, only toner is adhered to the development sleeve and conveyed to the development region which faces the photoreceptor having a latent image on its surface to be developed.

Concerning the toner concentration in the stirring unit, the density ranges of Method (b) and Method (c) are wider than the concentration ranges of Method (a). Furthermore, it has been found that excellent development can be carried out even if the concentration ranges are not maintained strictly. In the case of Method (a). the toner concentration range can be widened by using a carrier of a fine particle size.

The developing apparatus of the present invention has a feature that the toner concentration at the stirring unit can be controlled without using the conventional toner concentration detecting means and the toner supplying means based on the toner concentration detecting means. The developing apparatus of the invention is suitable for the above-mentioned developing methods (a). (b) and (c). and capable of supplying toner without using a complicated controlling system. The object of the present invention is to provide a developing apparatus with the features mentioned above.

SUMMARY OF THE INVENTION

The object of the present invention is to provide a developing apparatus, comprising; a developing sleeve, which rotates exerting influence of a magnetic field, with two-component developer, consisting of magnetic carrier and toner; a circulation system; a first housing having an upper portion relatively small: a second housing containing toner, wherein a passage is installed between the two housings, and the toner is supplied through the passage and the interface between the developer and the toner is located close to the passage. Furthermore, the developing apparatus of the present invention has a feature that a protrusion and a mechanism to prevent a reverse flow of toner to second housing is installed, wherein the mechanism is equipped with an opening/closing member which is capable of opening only in one direction.

BRIEF DESCRIPTION OF THE DRAWINGS

FIG. 5(*e*) shows several examples of valve members.

DETAILED DESCRIPTION OF THE INVENTION

Figure 1A:
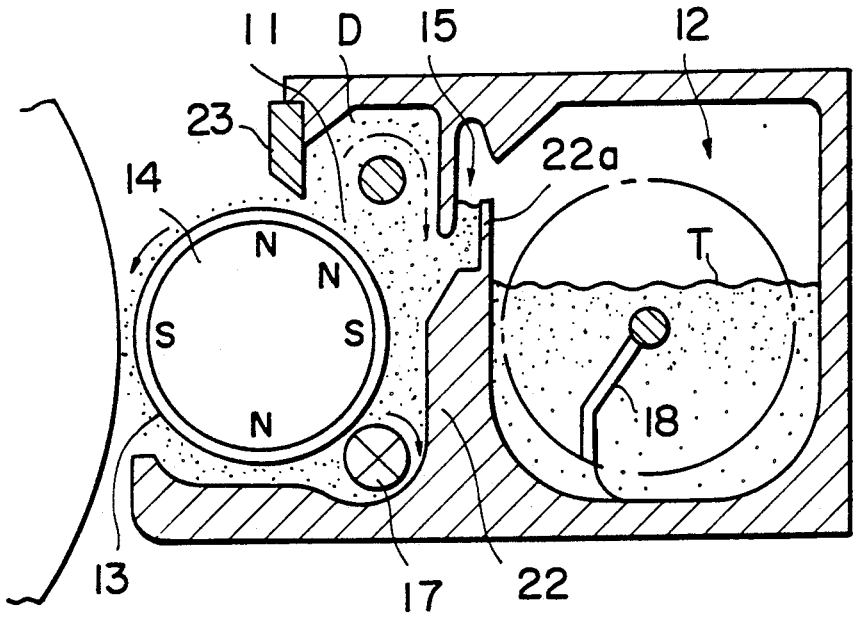
FIG. 1(*a*), FIG. 1(*b*), and FIG. 1(*c*) are sectional views which roughly show the structure of the developing apparatus and the main portions of the present invention.
Figure 1B:
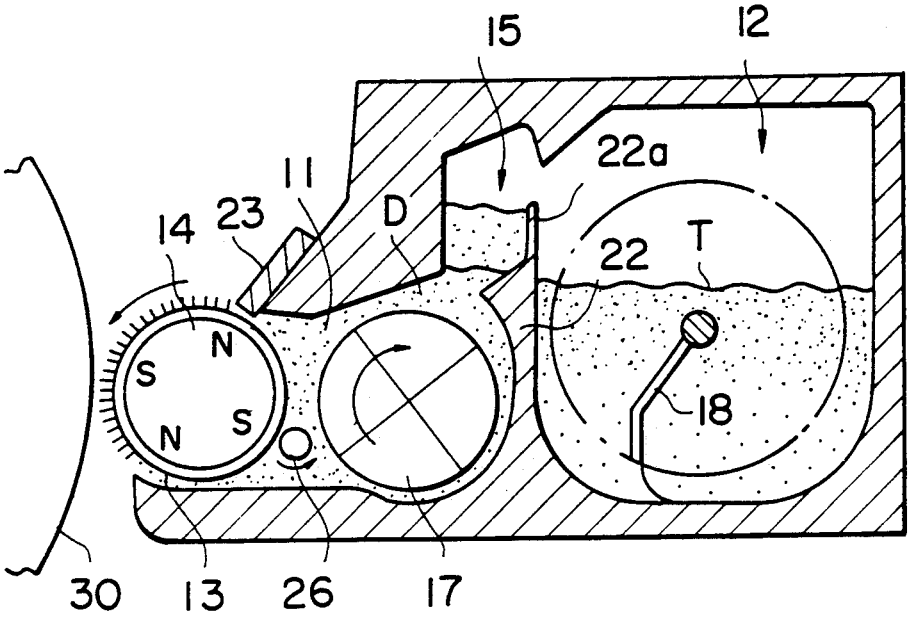
Figure 1C:
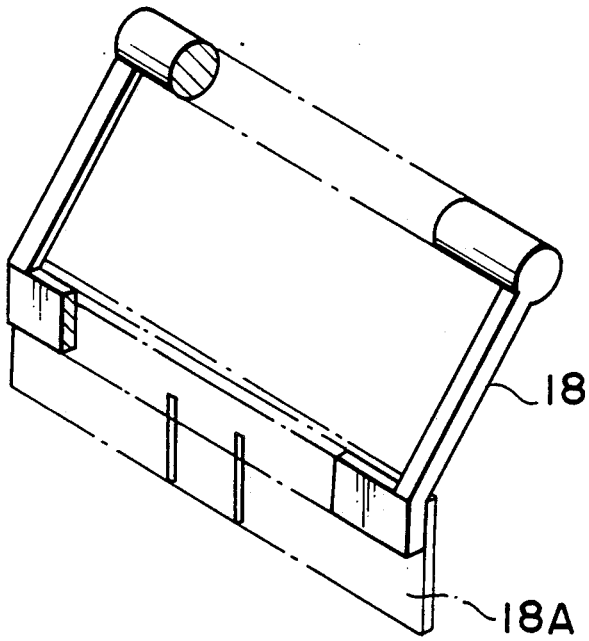
Figure 1D:
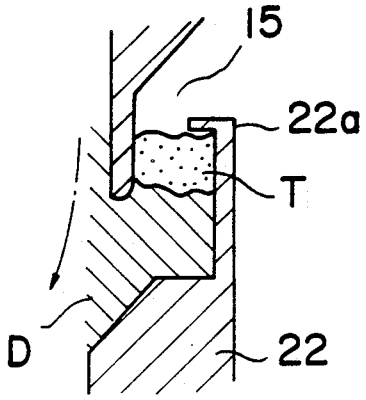

The present invention has been basically achieved due to the fact that toner in developer is consumed during development, but the magnetic carrier in the developer is not consumed, and therefore the concentration of toner in the developer varies.

The structure of the developing apparatus of the present invention will be described as follows. The developing apparatus is composed of a first housing in which the conveying force, generated by magnetic force, rotation of the developing sleeve and the stirring plate, forms a circulation system as a whole, and a second housing in which toner is contained. The two housings are separated by a partition plate and connected by a passage. The interface between the developer containing a proper toner density and the supplied toner is located close to the partition plate of the passage. The developer which has been used for developing and has a low toner concentration is mainly supplied to the area near the passage. The toner concentration control is conducted as follows. When the volume of developer is decreased because of a decrease of toner concentration, the interface of circulating developer is lowered and toner is supplied to the space where the interface existed. As a result, the volume of developer in the first housing in which the circulation system is installed, increases and the interface of the developer is raised. Then, the interface of the developer located close to the passage remains at a raised position and the toner supply is stopped.

For the effective supply of toner, it is preferable to meet the following requirements.

(I) The interface of circulating developer is stable and developer and toner are not stirred at a position close to the interface, especially on the side of the second housing in which toner is contained. Developer neither flows into the second housing where toner is contained nor does toner spread into the first housing.

(II) The passage should be of a structure sensitive to variations of the developer volume.

(1) The following means are effective in order to prevent developer from flowing into the second housing where toner is contained and to prevent toner from spreading into the first housing.

(1-1) In view of the fact that the specific gravity of the magnetic carrier is larger than that of the toner, passage 15 is located at the position as shown in the sectional view of FIG. 1(*a*), or it is located above the stirring unit as shown in FIG. 1(*b*).

(1-2) For instance, as shown in FIG. 1(*a*), in order to prevent developer D from spreading from passage 15 to second housing 12 which contains toner T, magnetic force is utilized. Magnetic force generated by the permanent magnet 14 installed inside the developing sleeve 13 can be used to achieve this object. The horizontal direction of magnetic force at passage 15 is more preferable than vertical direction magnetic force since the interface of developer is uniformly formed in the passage in the case in which horizontal direction magnetic force is exerted. To attain the object, the permanent magnet 14 is fixed and the N pole and the S pole are located as shown in the drawing.

(1-3) As shown in FIG. 1(*d*), the shape of the tip 22*a* of the partition plate is formed as follows. In order to return the developer D, which is circulating in the arrowed direction to the first chamber, the tip of the partition 22 is inclined. Furthermore, the shape of the tip 22*a* is to prevent the developer D from flowing through passage 15 into second chamber 12 which contains toner T.

(1-4) Furthermore, a protrusion may be provided on the tip of the partition 22 which is adjacent to the second chamber and this protrusion may be curved in order to prevent developer from flowing through passage 15 into the second chamber which contains toner T.

(1-5) In case the developing unit is overturned and developer D flows backward to second chamber 12 when the developing unit is removed from the image forming apparatus, an opening and closing member is installed close to passage 15 to prevent a reverse flow.

Meanwhile, in the case of (2), the following means are effective to make the position of the interface highly sensitive to the concentration of toner in the developer.

(2-1) For example, as shown in FIG. 1(*a*), the partition plate 22 is installed higher than stirring plate 17 and passage 15 has a small sectional area so that toner supply is conducted sensitively. The width of the passage is preferably 5 mm to 20 mm.

(2-2) The fear that the passage will become blocked by toner because the sectional area of passage 15 has been reduced as mentioned above, is dissipated by establishing toner bristles on the surface of the developing sleeve and furthermore establishing higher bristles by exerting a repulsive magnetic field on the developer.

The repulsive magnetic field is effective to prevent the developer from becoming blocked. Developer is liable to become blocked especially at the developer regulating unit composed of a height cutting plate and developer circulation tends to be obstructed. FIG. 1(*a*) shows a structure in which the permanent magnet 14 is fixed to exert the horizontal magnetic field to passage 15, and the drawing further shows the structure in which the magnetic field acts to scrape developer adhering to the developing sleeve 13 and the repulsive magnetic field prevents developer from blockage at the height cutting plate. In an example which will be explained later, the permanent magnet in the developing sleeve 13 is fixed. However, the structure of the apparatus is not limited to this. The apparatus can use the rotating permanent magnet 14 as well as the rotating developing sleeve.

In the case of the rotating magnet, a magnetic roller with 2 to 16 poles in which the N poles and S poles are alternatively aligned, is used at a revolution speed of 400 to 2000 rpm. The rotating direction is either the same direction as the developing sleeve or the opposite direction.

FIG. 1(*c*) shows the stirring member 18. A rubber plate, a resin plate made from Mylar or the like, or a resilient plate 18A made from phosphor bronze or the like is mounted on the tip of the stirring member 18. This stirring member is for scraping up toner T in the second chamber effectively and conveying it to passage 15.

Referring to Examples 1 to 4 of the present invention shown in the drawings, the present invention will be explained in detail. In the drawings, parts which have the same function are represented by the same numerals.

Figure 2:
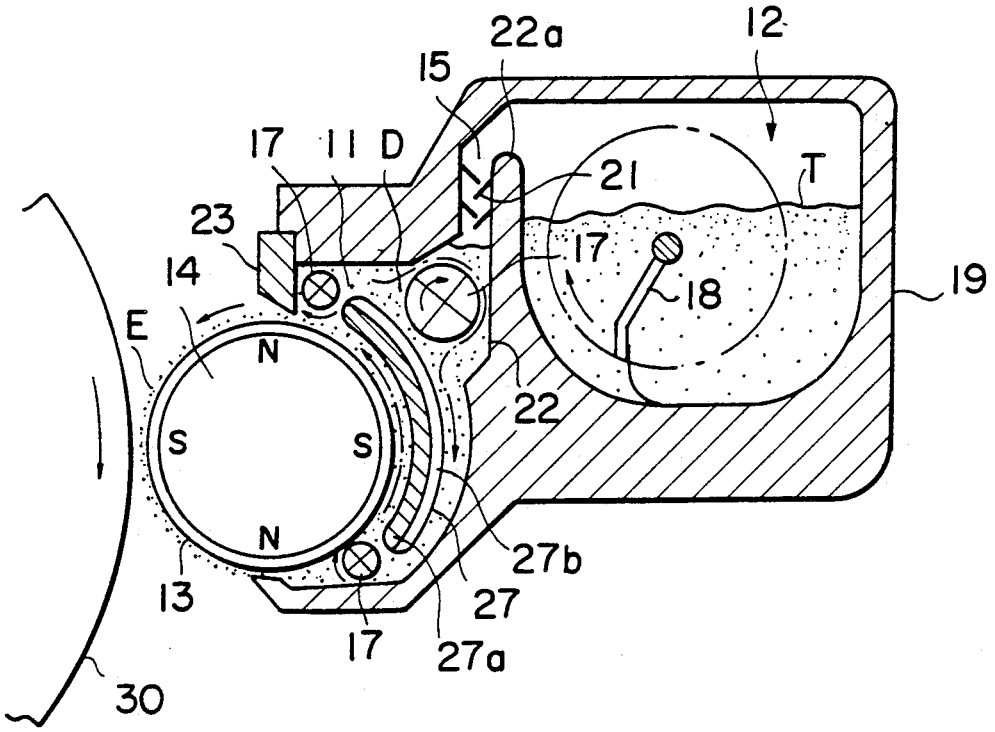
FIG. 2 is a sectional view which depicts the main portions of the first example of the present invention.

FIG. 2 is a sectional view of the main portion of the first example of the developing apparatus of the present invention. The numeral 11 is the first chamber where developer D is contained and stirred, and charged toner T is conveyed to the developing region E. The numeral 12 is the second chamber which is installed adjacent to first chamber and contains toner T. The numeral 13 is a developing sleeve made from non-magnetic materials or weak-magnetic materials such as stainless steel, aluminum, and the like. The developing sleeve rotates in the arrowed direction in the drawing. The numeral 14 is a permanent magnet which is installed inside the developing sleeve 13 and has a plurality of magnetic poles in the circumferential direction of the sleeve. The numeral 15 is a passage which is located between first chamber and second chamber 12 and connects the two chambers. The numeral 11*a* is the tip of the partition member 22 which interferes the stream of circulating developer D, which will be explained later. The numeral 27 is a partition plate which is located within first chamber 11 in parallel with the shaft of the developing sleeve 13. The side 27*a* of the plate facing the developing sleeve 13 is made from magnetic materials and the other side 27*b* facing the partition member 22 is made from non-magnetic materials.

The numeral 17 are developer mixing members which are also used to convey the developer, and they are located at positions close to the upper tip and the lower tip of the above-mentioned partition plate 27 facing the developing sleeve 13, and at a position close to the lower part of the passage.

The numeral 18 is a stirring member which stirs toner T contained in second chamber 12 and conveys it to passage 15.

The numeral 19 is a casing of the developing apparatus. The numeral 30 is a photoreceptor which holds latent images to be developed by the developing apparatus on the circumferential surface and forms the developing region E in the space between the photoreceptor and the developing sleeve 13.

Conveyance of developer D and supply of toner T in the above-mentioned developing apparatus are conducted as follows.

According to the rotary motion of the developing sleeve 13 and the mixing member 17 in the arrowed direction, developer D in first chamber 11 is conveyed around the partition plate 27 clockwise and circulated as shown by a dashed line. According to the circulation of developer D, toner is charged. Charged toner T is held by the developing sleeve 13 and conveyed to the developing region E.

Meanwhile, at passage 15, a clear interface is formed between developer D and toner T conveyed from second chamber 12, by the weight of developer D and the magnetic force of the permanent magnet 14. Because of the interface, developer D is easily prevented from flowing into second chamber 12 and spreading.

The interface between developer and toner is formed in the passage close to the first chamber, and the shape of the passage is formed narrower as the position in the aperture goes higher. Fluctuation of the interface caused by an inclined developing apparatus is prevented by this.

Furthermore, as a means to prevent a reverse flow of developer D to second chamber 12, when the developing unit is removed from the image forming apparatus, the protrusion members 21 are installed in passage 15.

The protrusion members 21 are composed of a plurality of plates which are arranged on the right and left alternately. Toner T conveyed to passage 15 from second chamber 12 drops easily to first chamber 11 through a zigzag-shaped passage formed by the protrusion members 21. On the contrary, developer D in first chamber 11 is prevented from flowing out because of the blockade of the reversely inclined protrusion members 21 even when the developing unit is overturned.

The width of passage 15 must be narrower than the width of first chamber in the direction of the shaft of the developing sleeve 13 and preferably the width of the passage is a third of that of first chamber 11. It is preferable that the length of the passage in the sectional direction of the apparatus is 5 to 20 mm. Since the passage 15 is made as explained above, the area of the interface between toner T and developer D is reduced. In this structure, the variation of the volume of developer D is increased. When toner T in developer D is consumed by development, the interface between developer D and toner T drops and toner T flows into first chamber 11 through passage 15 to supply a proper amount of toner.

Figure 3A:
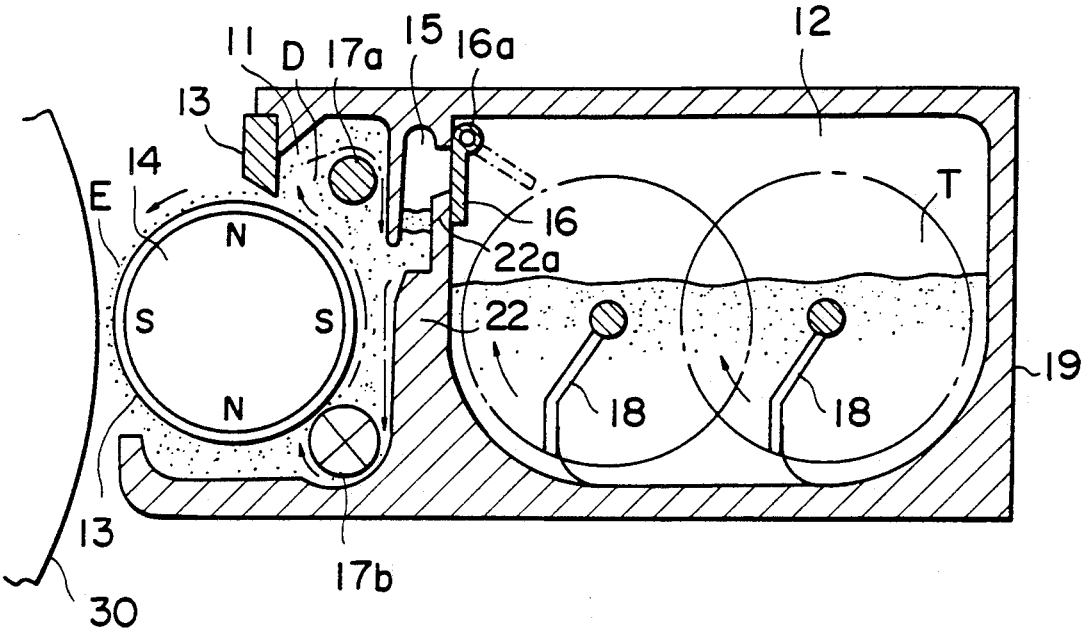
FIG. 3(*a*), FIG. 3(*b*), and FIG. 3(*c*) are sectional views and schematic illustrations of the second example of the developing apparatus of the present invention.
Figure 3B:
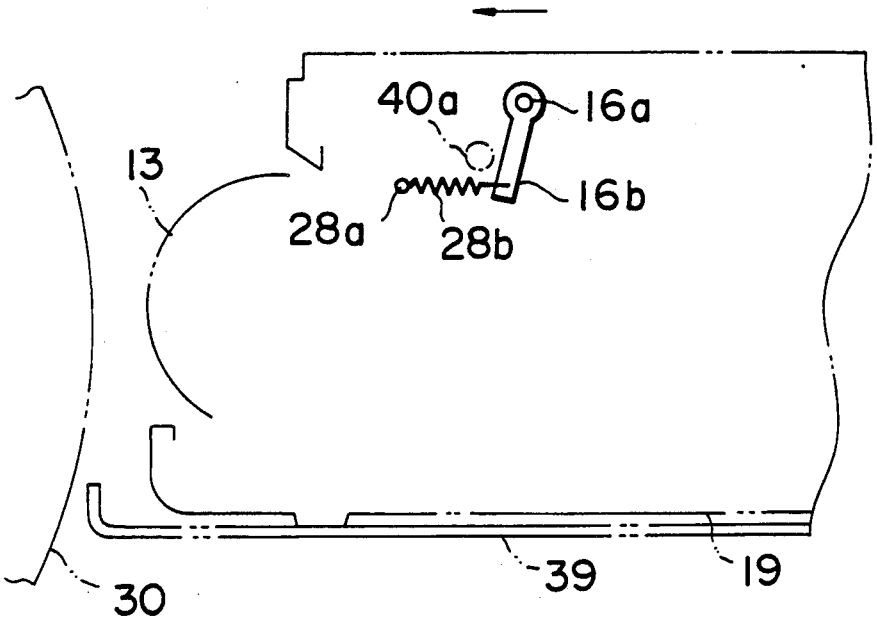

The second example of the present invention is shown in FIG. 3(*a*), FIG. 3(*b*), and FIG. 3(*c*).

The numeral 16 is an opening and closing member mounted on the inner wall of second chamber 12 which connects with passage 15. This member is mounted on shaft 16*a* and it can rotate on shaft 16*a* which is the supporting point of the motion.

The opening and closing member 16 as a valve member can close passage 15 by the device shown in FIG. 3(*b*) or FIG. 3(*c*).

As shown in FIG. 3(*b*) and FIG. 3(*c*), the numeral 16*b* is a lever fixed to the shaft 16*a* which protrudes from the rear outside portion of the casing 19. Therefore the lever 16*b* is connected with the above-mentioned opening and closing member 16 through the shaft 16*a*.

The lever 16*b* is pulled clockwise by the spring 28*b* which is stretched between the lever and the pin 28*a* mounted on the rear outside portion of the casing 19. Accordingly, as shown in FIG. 3(*a*), the opening and closing member 16 is pressed by the spring force to the position represented by a dashed line in the drawing. As a result, the opening and closing member closes passage 15 and prevents developer D from flowing into second chamber 12.

The numeral 17*a* is a cylindrical member made from non-magnetic material which is installed approximately at the center of the first chamber in parallel with the shaft of the developing sleeve 13. The numeral 17*b* is a rotative oval stirring plate as a developer mixing member which is installed at a position close to the developing sleeve 13. The numeral 18 is a pair of stirring plates to stir toner T which rotate in the arrowed direction. The numeral 19 is a casing. The numeral 30 is a photoreceptor which holds on its surface latent images to be developed by this developing apparatus. The letter E represents the development region where the above-mentioned development is conducted.

Since the structure of the second example is composed as explained above, developer D is stirred by the rotating development sleeve 13 and the rotating oval stirring plate 17*b* and conveyed below the fixed cylindrical member 17*a* in the arrowed direction drawn by a dashed line. After that, developer passes above cylindrical member 17*a* and goes down towards the oval stirring plate 17*b*. Developer D circulates in first chamber 11 in this way.

A rotating rod made from non-magnetic materials and a brush may be used as cylindrical member 17*a* as well as a simple rod. Developer D can supply charged toner T to the development region E by this circulation of developer. While developer D is circulating, a developer layer is formed in passage 15 in the upper stream of developer flow by the magnetic force of the developing sleeve. Gravity and the magnetic force of the permanent magnet 14 combine with each other to completely prevent developer D from spreading into second chamber 12 to form the interface between developer and toner in the passage.

In the second example, the length of the passage in the direction parallel to the shaft of the developing sleeve 13 and the length of the passage in the sectional direction of the apparatus are the same as in the first example. To be more specific, the area where the interface between toner T and developer D is formed is reduced so that the variation of the volume of developer D is indicated clearly.

When the toner in developer D is consumed by development, the interface of developer D goes down and toner T flows into first chamber 11 through passage 15 to supply a proper amount of toner to first chamber 11. When the developing unit is mounted on the image forming apparatus or the main switch of the apparatus is turned on, the opening and closing member 16 rotates counter clockwise according to the motions mentioned above and passage 15 is opened.

FIG. 3(*b*) shows the device to open passage 15 by the motion of mounting the developing unit onto the apparatus. When the developing unit is set on the developer base plate 39 in the image forming apparatus and slid towards the photoreceptor 30 (in the direction of an arrow), the lever 16*b* comes into contact with the pin 40*a* installed on the side wall of the developer base plate 39 and the opening and closing member 16 is rotated counterclockwise by this motion.

Figure 3C:
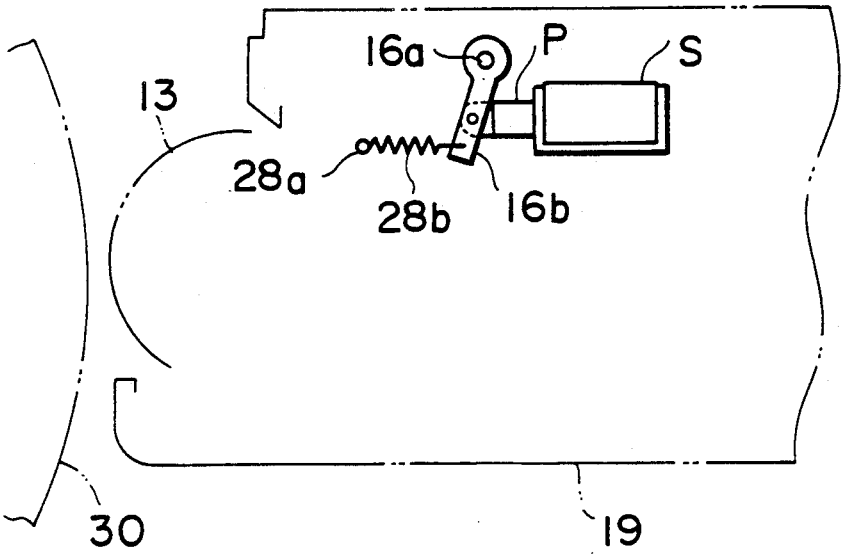

FIG. 3(c) shows the position of the lever 16*b* when it opens passage 15 by the motion of turning on the main switch. The letter S is a solenoid which is mounted on the rear outside of the developing unit. The letter P is its plunger and the tip of the plunger is connected with the lever 16*b* rotatively. Therefore, when the solenoid S is turned on and the plunger P is attracted, the lever 16*b* is rotated counterclockwise to open the opening and closing member 16.

Accordingly, even if the developing unit is overturned when it is removed from the image forming apparatus, the developer D in first chamber 11 is blocked by the opening and closing member 16. So, there is no fear that developer D flows into second chamber 12. When the developing unit is in operation and the toner in developer D is consumed, the interface of the developer goes down and toner T flows into first chamber 11 through passage 15 to supply a proper amount of toner.

Figure 4A:
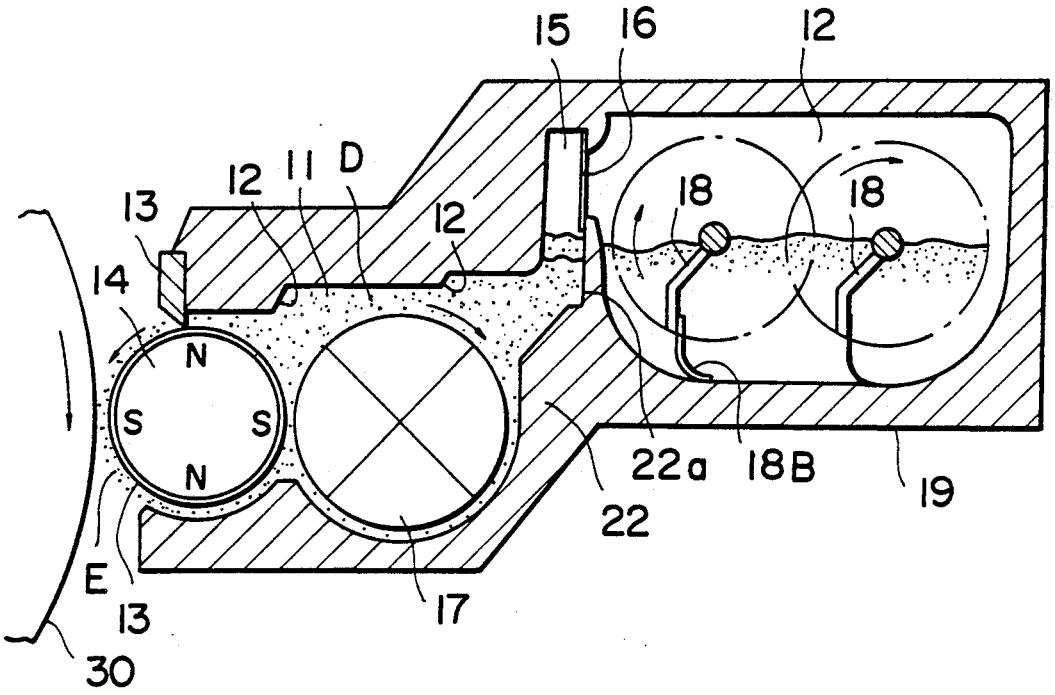
FIG. 4(*a*), FIG. 4(*b*), and FIG. 4(*c*) are sectional views and main portion views of the third example of the developing apparatus of the present invention.
Figure 4B:
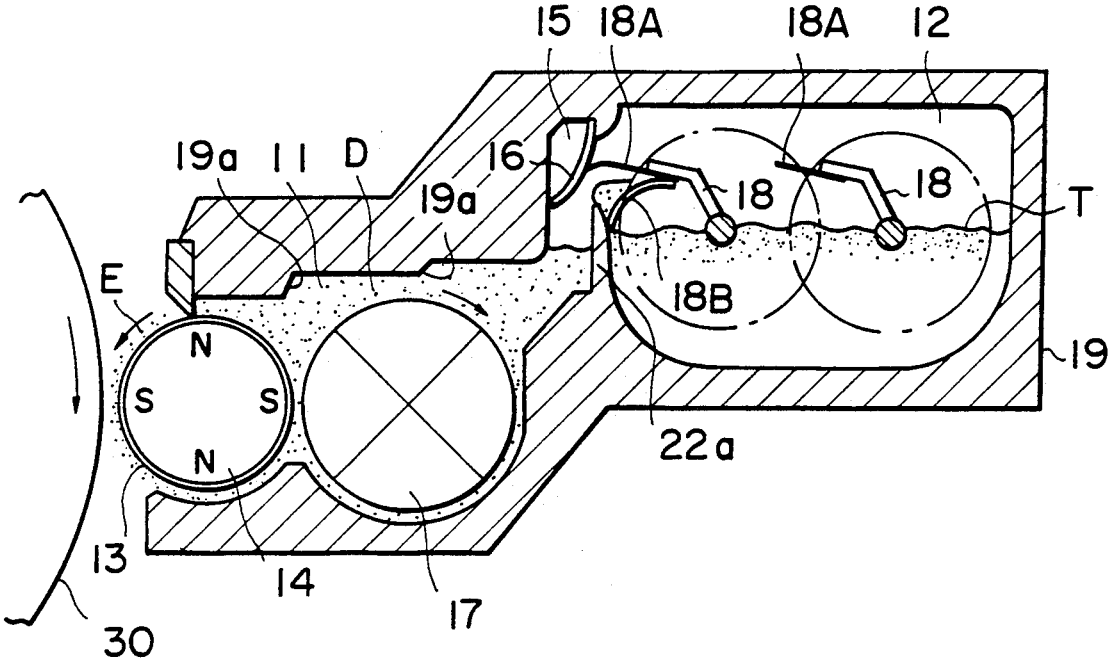
Figure 4C:
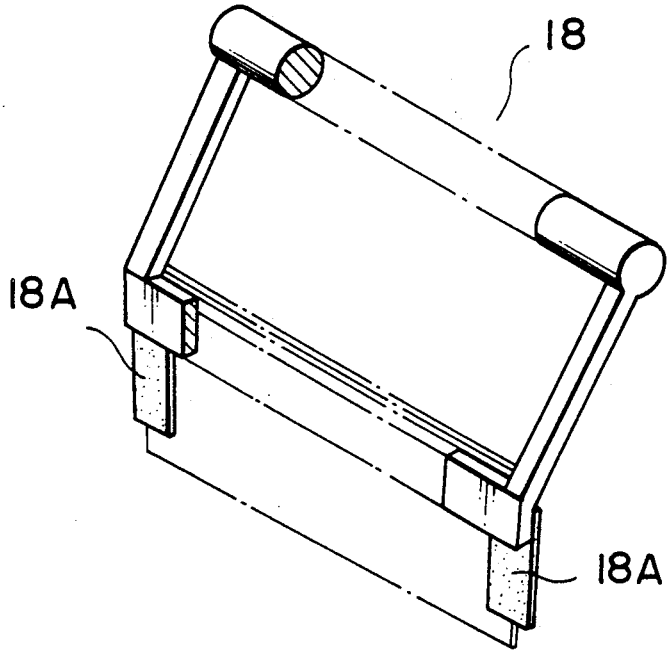
Figure 5A:
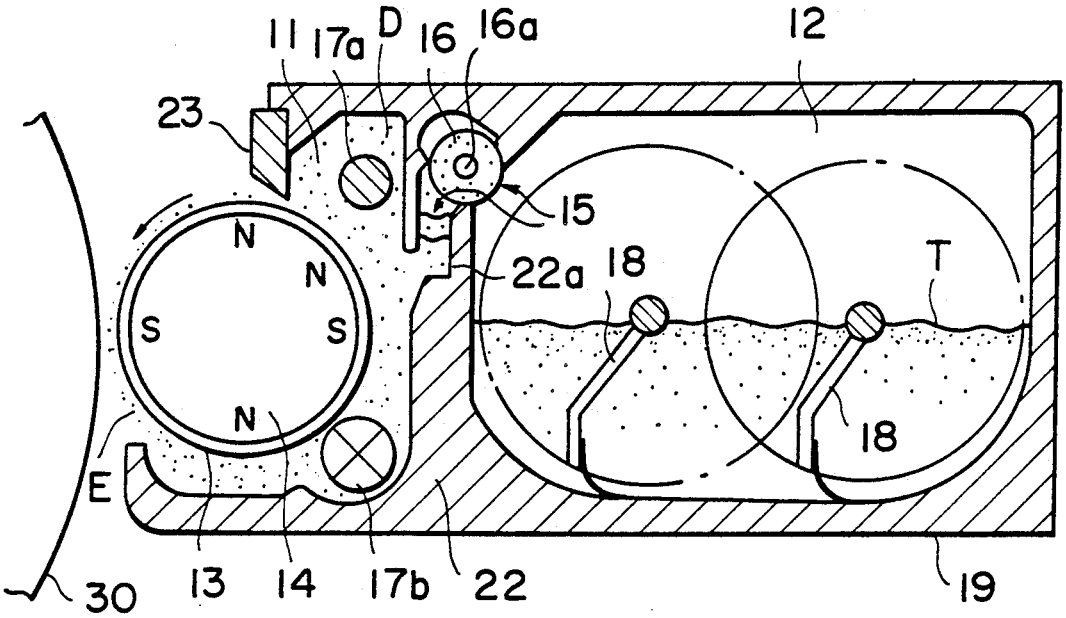
FIG. 5(*a*), FIG. 5(*b*), FIG. 5(*c*), and FIG. 5(*d*) are sectional views of the fourth example of the developing apparatus of the present invention.
Figure 5B:
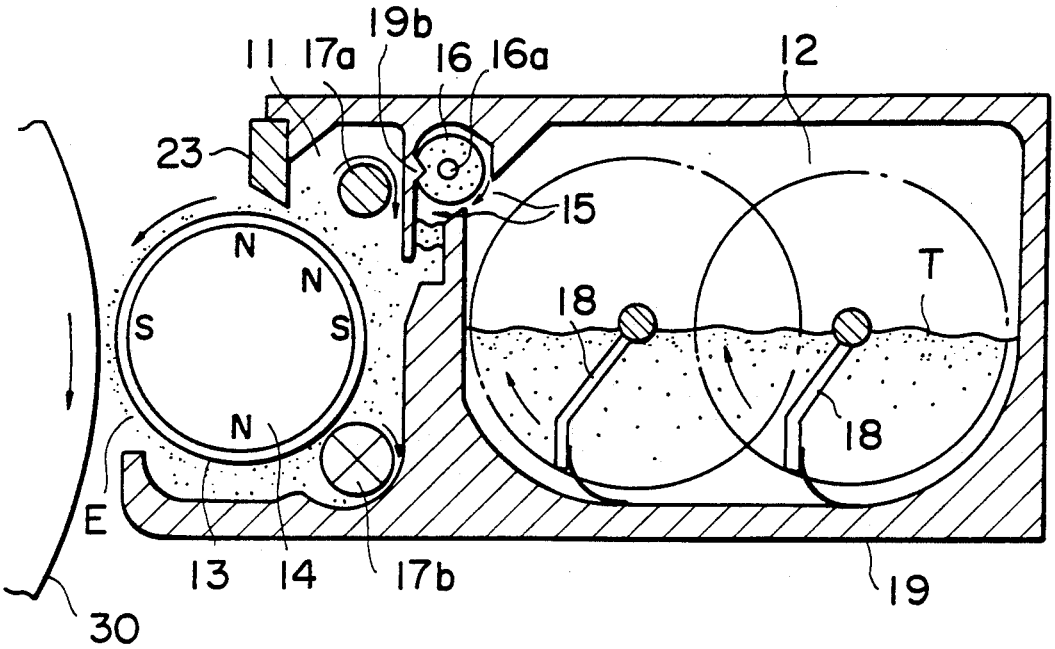
Figure 5C:
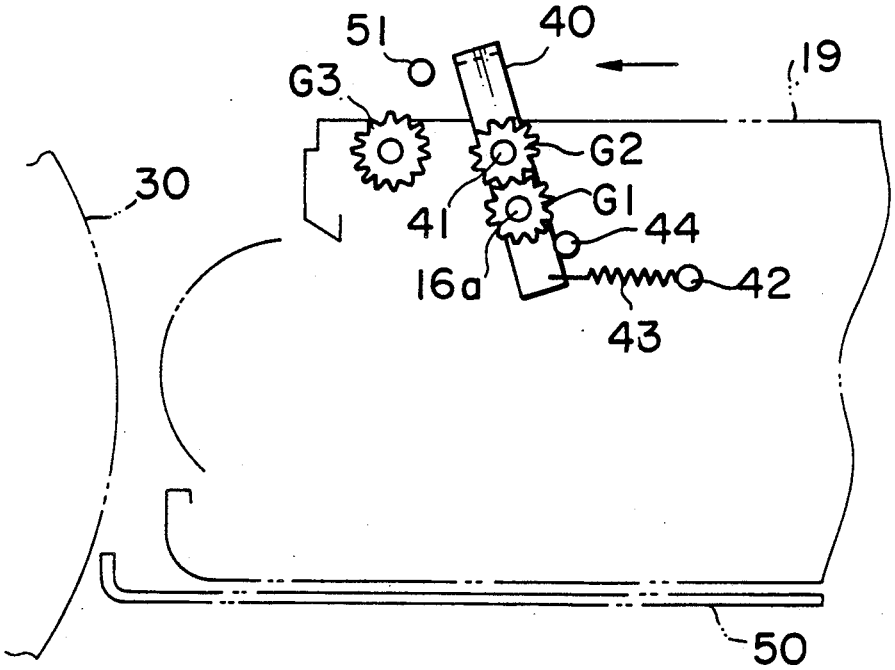
Figure 5D:
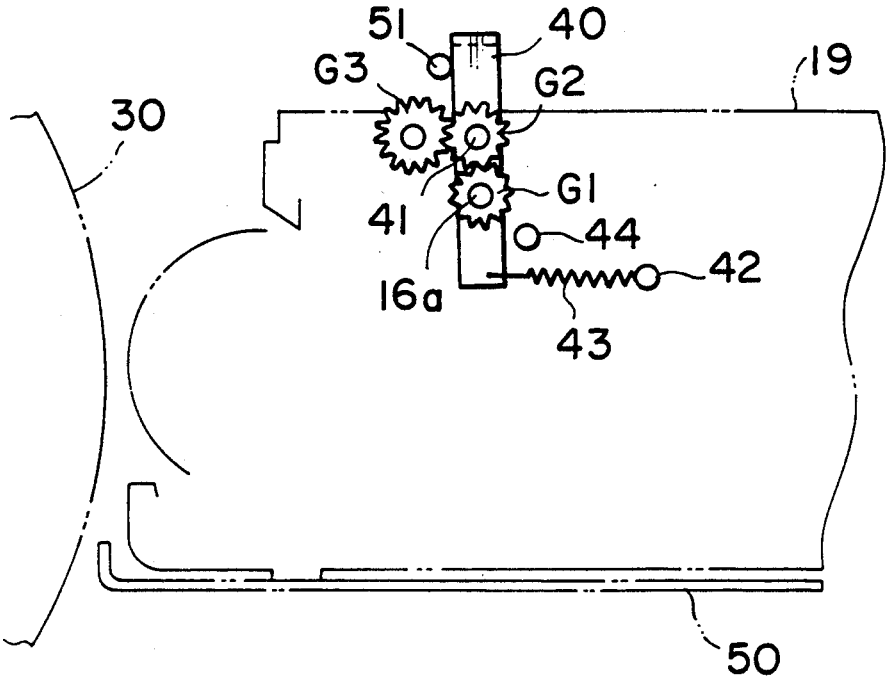
Figure 5E:
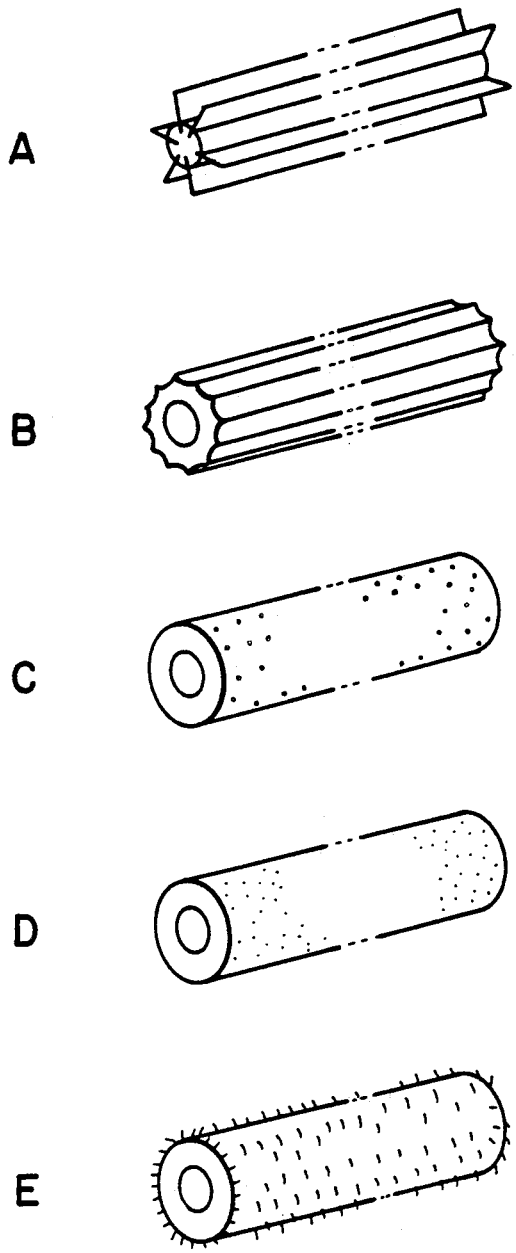

The third example of the present invention is shown in FIG. 4(*a*), FIG. 4(*b*), and FIG. 4(*c*). The numeral 16 is a shield plate, the upper portion of which is adhered to the outer wall of second chamber 12 connected with passage 15.

The shield plate 16 is made of a very thin metal plate. It is a resilient plate-shaped member and the aperture 15 is always closed by its resilience. Consequently, even if the developing unit is overturned when it is dismounted from the image forming apparatus, developer D is prevented from flowing into second chamber 12 by the resilient shield plate 16, as well as preventing toner T from unexpectedly flowing into first chamber 11 from second chamber 12.

The numeral 17 is a rotating oval stirring plate as a developer mixing member installed at a position close to the developing sleeve 13. The numeral 18 is a pair of stirring members which rotate in the arrowed direction to stir toner T.

One of the stirring members 18 which is installed on the side of first chamber 11 has the structure shown in FIG. 4(*c*).

The resilient plates 18A are mounted on the sides of stirring member 18. Furthermore, Mylar plate 18B is mounted on stirring member 18 overlapping the resilient plates 18A.

The tip of Mylar plate 18B sticks out a little from the tip of the resilient plates 18A and the Mylar plate forms a separate body from the resilient plates 18A except for their adhered surfaces.

When the stirring members 18 rotate in the arrowed direction, the above-mentioned resilient plates 18A and Mylar plate 18B stir toner T together as a pair. When the resilient plates 18A reach passage 15 and come into contact with the shield plate 16, they push the shield plate 16 by resilience and bend the plate as shown in FIG. 4(*b*). As a result, passage 15 is opened.

Then, toner T which is scooped up by Mylar plate 18B in the next rotation, is conveyed to first chamber 11 through the opened passage 15.

After toner has been supplied, the resilient plates 18A and Mylar plate 18*b* stir toner T. The curved shield plate 16 reverts to a flat plate to close the aperture 15.

The numeral 19 is a casing of the developing unit. In the present invention, the surfaces 19*a* facing towards passage 15 are formed on the upper side inside the casing 19 in order to prevent developer D from flowing into second chamber 12 and furthermore to form positively the interface between developer D and toner T in passage 15. The object of the surfaces 19*a* inside the casing is to form a stable interface of developer at the lower portion of the passage even when the developing unit is inclined. The numeral 30 is the photoreceptor which holds on its circumferential surface latent images to be developed by the developing unit. The letter E is the developing region where development is conducted.

The third example of the present invention is composed as explained above. Therefore, developer D is stirred and circulated by the rotating developing sleeve 13 and the rotating oval stirring plate 17 as a developer mixing member Developer D can supply charged toner T to developing region E by this developer circulation. While developer D is circulating, a layer of developer is formed at passage 15 on the upstream side by the magnetic force of the developing sleeve. To be more specific, gravity and the magnetic force of the permanent magnet 14 combine to completely prevent developer D from spreading into second chamber 12, and to form the interface between developer and toner. When the toner in developer D is consumed, the interface goes down and toner T flows into first chamber 11 through tpassage 15 by the motion of the stirring member 18 explained above. Toner is supplied properly in this way.

In this third example of the present invention, the size of passage 15 is the same as in the first and the second examples in terms of the length of the passage in both of the direction of the shaft of the developing sleeve and the sectional direction of the developing unit. The area of the passage is narrowed so that the interface between toner T and developer D is formed in the passage, and the variation of the volume of developer D is clearly detected.

The fourth example of the present invention is shown in FIG. 5(*a*), FIG. 5(*b*). FIG. 5(*c*). FIG. 5(*d*), and FIG. 5(*e*).

The numeral 17*a* is a cylindrical member made from non-magnetic material which is installed approximately at the center of first chamber in parallel with the shaft of the developing sleeve 13. The numeral 17*b* is a rotating oval plate as a developer mixing member installed close to the developing sleeve 13. The numeral 18 are stirring members to stir toner T which rotate in the arrowed direction. The numeral 19 is a casing. The numeral 30 is a photoreceptor which holds latent images to be developed by this developing unit on its circumferential surface. The letter E is a developing region where development is conducted.

The rotating member 16 (as a valve member) is driven by the drive unit shown in FIG. 5(*c*) and FIG. 5(*d*), and this member is used as the shield member to open and close passage 15.

In FIG. 5(*c*), the numeral 16*a* is a rotating shaft which, with the above-mentioned rotating member 16, forms one body. The numeral 40 is a U-shaped support member which supports the rotating shaft 16*a* rotatably at the outside side walls of both sides of the casing. The numeral 41 is a pin by which the above-mentioned support member 40 is held at both side walls of the casing 19. The support member 40 is pulled Counterclockwise by the tension spring 43 which is stretched between the support member and the pin 42 on one of the side walls of the casing 19. The pulled support member comes into contact with the stop pin 44 with pressure and its counterclockwise motion is stopped. G1 is a gear which is fixed to the end of the rotating shaft 16*a* and it forms one body with the rotating member 16. G2 is an idle gear which is engaged with the gear GI and held by the support pin 41 rotatably. G3 is a drive gear which is driven by the power of the image forming apparatus and installed at a fixed position.

When the developing unit is not set in the image forming apparatus or it is not set at the right position in the apparatus, the support member 40 is in the position shown in FIG. 5(*c*), and the rotating member 16 shifts to the right to close passage 15 as shown in FIG. 5(*a*). In this case, of course, the idle gear G2 is not engaged with the drive gear G3.

When the developing unit is moved in the arrowed direction, sliding on the developer base plate 50, the support member 40 comes into contact with the pin 51 mounted on the apparatus, and rotates clockwise and the idle gear G2 engages with the drive gear G3 as shown in FIG. 5(*d*).

As a result, the rotating member 16 moves to the left and opens the aperture 15 as shown in FIG. 5(*b*). The rotating member 16 starts rotating through the idle gear G2 and the gear GI by the power of the drive gear G3 which starts rotating when the main switch is turned on.

Therefore, toner T which was conveyed to passage 15 by the stirring member 18 adheres to the circumferential surface of the rotating member 16 and is scraped off by the scraper 19*b* which sticks out from a portion of the casing 19.

In example 4, the sectional size of passage 15, to be more specific, the length of the passage in the direction of the shaft of the developing sleeve and the length of the passage in the sectional direction of the developing unit are the same as in the first example, the second example, and the third example.

FIG. 5(*e*) shows several examples of the rotating member 16 which are considered to be practical. Example A is composed of fins made of resilient plates such as a film, a phosphor bronze plate and the like. Example B has a wave-shaped circumferential surface. Example C is a porous roller. Example D is a sponge roller. All of them are made from synthetic resins which are easy to mold and wear-resistant rollers are used. A fur brush like E may be used.

The structure of the fourth example is explained above. Developer D circulates in the developing unit as follows. Developer D is stirred by the rotating sleeve 13 and the rotating oval stirring plate 17*b* and conveyed below the fixed cylindrical member 17*a* in the arrowed direction. After that developer D passes above the rod-shaped member 17*a* to circulate. A rugged rotatable non-magnetic rod, a brush or the like may be used as the cylindrical member 17*a*. Since developer D is circulated as mentioned above, charged toner T can be supplied to the development region E. While developer D is circulating in the way mentioned above, a layer of developer is formed at the passage by the magnetic force of the developing sleeve. In other words, gravity and the magnetic force of the permanent magnet 14 prevent completely developer D from spreading into second chamber 12 and an interface is formed between developer and toner.

When the toner in developer D is consumed during development, the interface of developer D goes down and toner T flows into first chamber 11 to supply a proper amount of toner.

As explained above, a developing unit with a simple structure in which developer D is stirred and toner T is supplied properly, can be obtained in all of the examples. They are the first example, the second example, the third example, and the fourth example.

The following experiments have been carried out with the first example to the fourth example in order to check the efficiency of the present invention. Magnetic particles with an average particle size 60 $\mu$m, wherein fine-grain ferrite was dispersed in the resin by 70 weight percent, and whose magnetization was 30 emu/g, and to which the process to make its particles spherical by the heat treatment with not less than $10^{14}$ ucm electrical resistivity was conducted, were used as the carrier. Non-magnetic particles with an average particle size of 5 $\mu$m were used as toner. The apparatus shown in FIG. 1 was used in the experiment Development was conducted under the conditions that the toner particle ratio in developer D in first chamber 11 is 10 weight percent. A non-magnetic metal plate was used as height cutter 23. The average static charge of toner was 7 $\mu$C/g.

In this case, the conditions of the photoreceptor 30 were as follows. The photoreceptor 30 was an OPC photoreceptor. Its circumferencial speed was 90 mm/sec. The maximum voltage of the electrostatic latent image formed on the photoreceptor was −500 V and the minimum one was −100 V. The diameter of the sleeve 13 was 30 mm and its revolution was 75 r.p.m. The maximum flux density of the magnetic pole of the magnet 4 facing the development region E was 900 gauss and the flux density of the magnetic pole of the other portion was 800 gauss. The thickness of the developer layer consisting of carrier and toner was 0.4 mm before the developer entered the development region E. The D.C. voltage component of the bias voltage to be added to the sleeve 13 was −200 V and the A.C. voltage component was 2 KHz 800 V. In this example, the gap between the sleeve 13 and the photoreceptor 30 was 0.6 mm. So, the two component developer on the developing sleeve 13 did not come into contact with the surface of the photoreceptor 30.

Development was carried out under the conditions mentioned above. The images were transferred to plain papers with corona discharge and fused by passing through the heated roller type fusing unit, wherein the surface temperature of the roller was 140° C. The results of the experiments were excellent. The obtained images on recording papers were very clear without edge effects and fog, and furthermore the image density was high and the images were extremely clear. The experiments tested 50,000 recording papers. Stable and constant images were able to be obtained from the beginning of the test to the end.

As explained above, the developing apparatus of the present invention comprises; a first chamber in which developer is contained, and a rotating sleeve is installed which exerts a magnetic field and forms the developer circulation system: a second chamber in which toner is contained; and a partition member between the two chambers, wherein the interface of the above-mentioned developer is set at the passage of the partition so that a complicated operation can be eliminated, the structure of the apparatus can be made very simple, toner can be supplied to the developer properly, and the cost is reasonable. The developing apparatus of the present invention has the excellent effects explained above.

What is claimed is:

1. A developing means for a photoelectric copying apparatus wherein a developer having a volume and comprising a toner and a magnetic carrier is used, said developing means comprising:

a toner housing assembly comprising a toner housing containing said toner, and a toner conveyance means within said toner housing for conveying said toner to a developer having an upper surface housing, and a developer housing assembly comprising (a) said developer housing for containing said developer, (b) a rotating developing sleeve having a plurality of magnetic poles therein for supplying said toner to a photoreceptor to develop a latent image formed thereon, (c) a developer circulation means for mixing and circulating said toner and said magnetic carrier in said developer housing, and (d) a passageway between said toner housing and said developer housing through which toner can be supplied to said developer housing from said toner housing, said passageway being narrower than the upper surface of said developer housing and shaped so that toner supplied from said toner housing, when the volume of developer in said developer housing is reduced, forms a distinct layer on top of said developer in said developer housing, without mixing, in an area adjacent said passageway.

2. The apparatus claimed in claim 1, wherein said passage member is provided directly above said developer circulation means.

3. The apparatus claimed in claim 1, wherein said passageway has a width between 5 mm and 20 mm in the direction transverse to the axis of said developing sleeve.

4. The apparatus claimed in claim 1, wherein said passageway has a length one third of that of said toner housing in the direction parallel with the axis of said developing sleeve.

5. The apparatus claimed in claim 1, wherein said passageway is provided with a protrusion member for preventing the backflow of said toner from said developer housing to said toner housing.

6. The apparatus claimed in claim 1, wherein said passageway is provided with a valve member for preventing the backflow of said toner from said developer housing to said toner housing.

7. The apparatus claimed in claim 6, wherein said valve member has an opening and closing mechanism.

8. The apparatus claimed in claim 7, wherein said valve member opens when the developing apparatus is in operation and closes when the developing apparatus is in suspension.

9. The apparatus claimed in claim 6, wherein said valve member is made of an elastic material.

10. The apparatus claimed in claim 6, wherein said valve member is a sponge roller with an opening and closing mechanism.

11. The apparatus claimed in claim 10, wherein said valve member opens when the developing apparatus is in operation and closes when the developing apparatus is in suspension.

* * * * *